US008379069B2

(12) United States Patent
Tamura et al.

(10) Patent No.: US 8,379,069 B2
(45) Date of Patent: Feb. 19, 2013

(54) THERMAL PRINTING APPARATUS AND CONTROL METHOD THEREOF

(75) Inventors: Toshiyuki Tamura, Shizuoka (JP); Kaname Iga, Shizuoka (JP); Okiharu Matsuda, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 342 days.

(21) Appl. No.: 12/878,561

(22) Filed: Sep. 9, 2010

(65) Prior Publication Data

US 2011/0069131 A1 Mar. 24, 2011

(30) Foreign Application Priority Data

Sep. 18, 2009 (JP) ..... 2009-216338

(51) Int. Cl.
*B41J 2/00* (2006.01)

(52) U.S. Cl. ..... 347/189

(58) Field of Classification Search ..... 347/188, 347/189, 190, 191, 192, 194, 195, 120.14, 347/120.15

See application file for complete search history.

(56) References Cited

U.S. PATENT DOCUMENTS 5,059,044 A * 10/1991 Takaishi ..... 400/120.14
6,476,838 B1 * 11/2002 Italiano ..... 347/192

FOREIGN PATENT DOCUMENTS

JP 06-286196 10/1994
JP 410226076 * 8/1998
JP 2001-310494 11/2001

* cited by examiner

*Primary Examiner* — Kristal Feggins
(74) *Attorney, Agent, or Firm* — Turocy & Watson, LLP

(57) ABSTRACT

A thermal printing apparatus includes a thermal head having a plurality of heating elements arranged in a line. The thermal printing apparatus may further includes a control unit configured to determine conduction times of the heating elements based on print rates respectively assigned to the plurality of heating elements. The control unit may be further configured to compensate each of the determined conduction times based on the conduction times of the heating elements other than the respective heating element to determine a plurality of compensated conduction times. The control unit may control each of the plurality of heating elements based on the respective one of the plurality of compensated conduction times to enable the thermal head to perform printing on a recording medium.

20 Claims, 8 Drawing Sheets

THERMAL PRINTING APPARATUS AND CONTROL METHOD THEREOF

CROSS-REFERENCE TO RELATED APPLICATIONS

This application is based upon and claims the benefit of priority from Japanese Patent Application No. 2009-216338 filed on Sep. 18, 2009, the entire contents of which are incorporated herein by reference.

FIELD

Embodiments described herein relate generally to a thermal printing apparatus equipped with a thermal head incorporating a plurality of heating elements divided into several blocks, and a control method thereof.

BACKGROUND

Typically, a thermal printing apparatus employs a thermal head incorporating therein a plurality of heating elements arranged in a line, which may be divided into a plurality of blocks. It has been known that temperature differences between the divided blocks in the thermal head cause unevenness in the printed result, hampering high-quality printing. Some approaches to cope with this problem are known.

DETAILED DESCRIPTION

According to an embodiment, a thermal printing apparatus is provided. The thermal printing apparatus may comprise a thermal head having a plurality of heating elements arranged in a line. The thermal printing apparatus may further comprise a control unit configured to determine conduction times of the heating elements based on print rates respectively assigned to the plurality of heating elements. The control unit may be further configured to compensate each of the determined conduction times based on the conduction times of the heating elements other than the respective heating element to determine a plurality of compensated conduction times. The control unit may control each of the plurality of heating elements based on the respective one of the plurality of compensated conduction times to enable the head to perform printing on a recording medium.

Hereinafter, embodiments described herein will be described in further detail by way of example with reference to the accompanying drawings.

Figure 1:
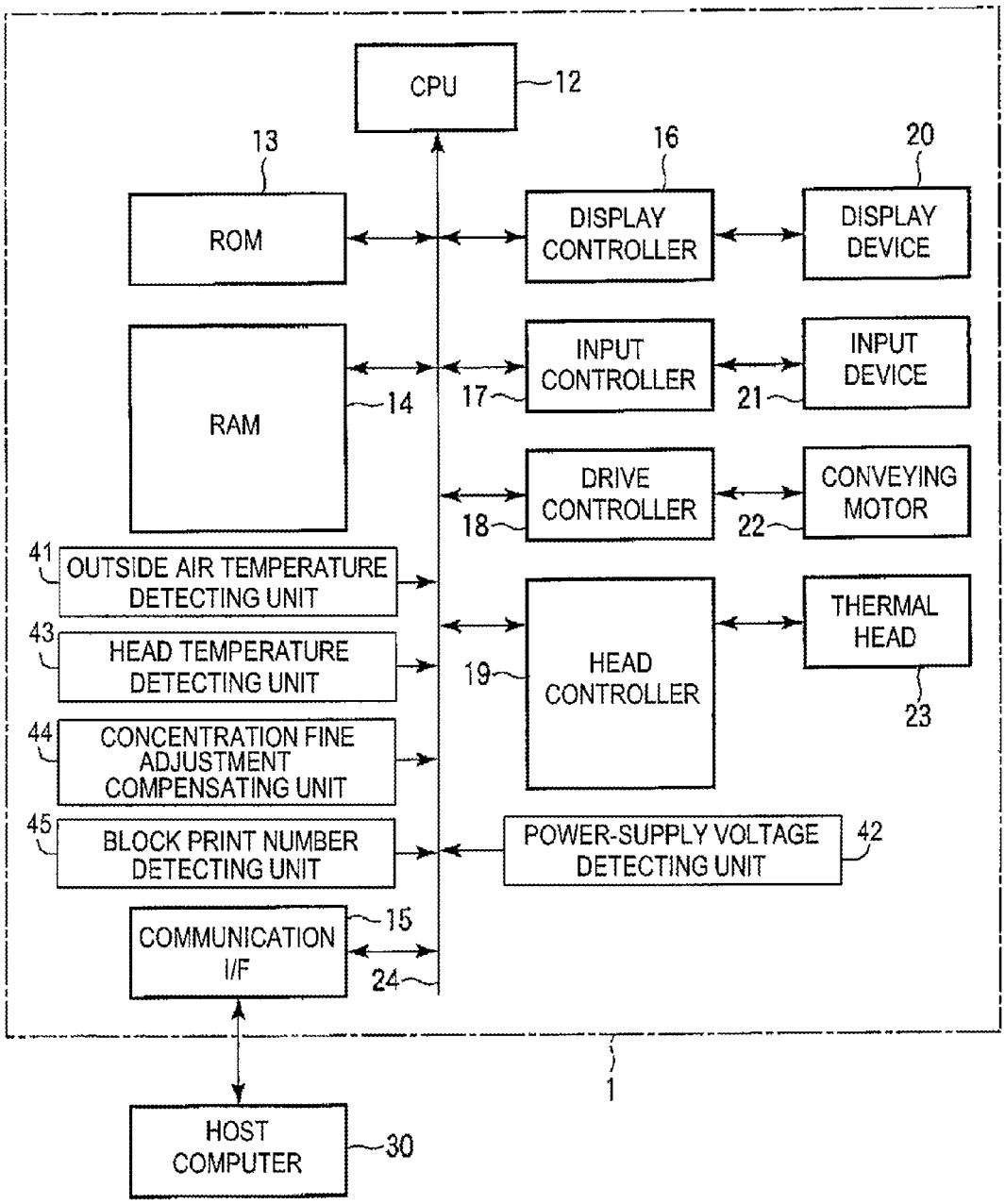
FIG. 1 is an illustrative embodiment of a block diagram of a thermal printing apparatus.

Referring to FIG. 1, an illustrative embodiment of a thermal printing apparatus 1 is shown in detail. As shown in FIG. 1, the thermal printing apparatus 1 may include a central processing unit (CPU) 12 configured to control the overall operations of the thermal printing apparatus 1 and a bus line 24 to connect the CPU 12 to various units (as will be described hereinafter) in the thermal printing apparatus 1. The thermal printing apparatus 1 may further include a ROM 13 to store various operation programs, a RAM 14 to store at least part of the various operation programs, data formats produced as a result of the processing by the CPU 12, various control information, and a communication interface (I/F) 15 configured to enable communication with an external device, such as a host computer 30, through a network. The thermal printing apparatus 1 may further include a display device 20 that may display an image to be printed and various operation-related information, a display controller 16 configured to control the display device 20, and an input device 21, such as a keyboard, a scanner, configured to input operation-related information or data associated with the data formats. The thermal printing apparatus 1 may further include an input controller 17 configured to control the input device 21, a conveying motor 22 configured to convey a recording medium, such as printing paper, on which an image will be printed, a drive controller 18 configured to control the operations of the conveying motor 22, a thermal head 23 operable as a printing unit to print an image on the recording medium, and a head controller 19 configured to drive the thermal head 23.

Figure 2:
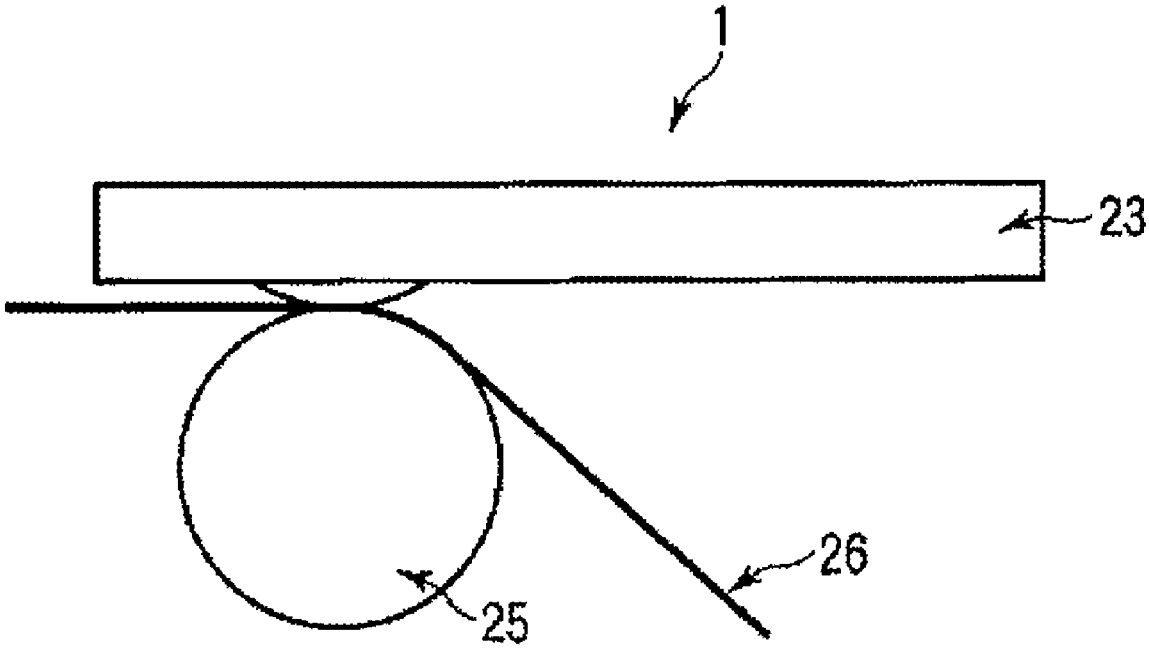
FIG. 2 is an illustrative embodiment of a sectional view showing a thermal head and its peripheral parts of the thermal printing apparatus.
Figure 3:
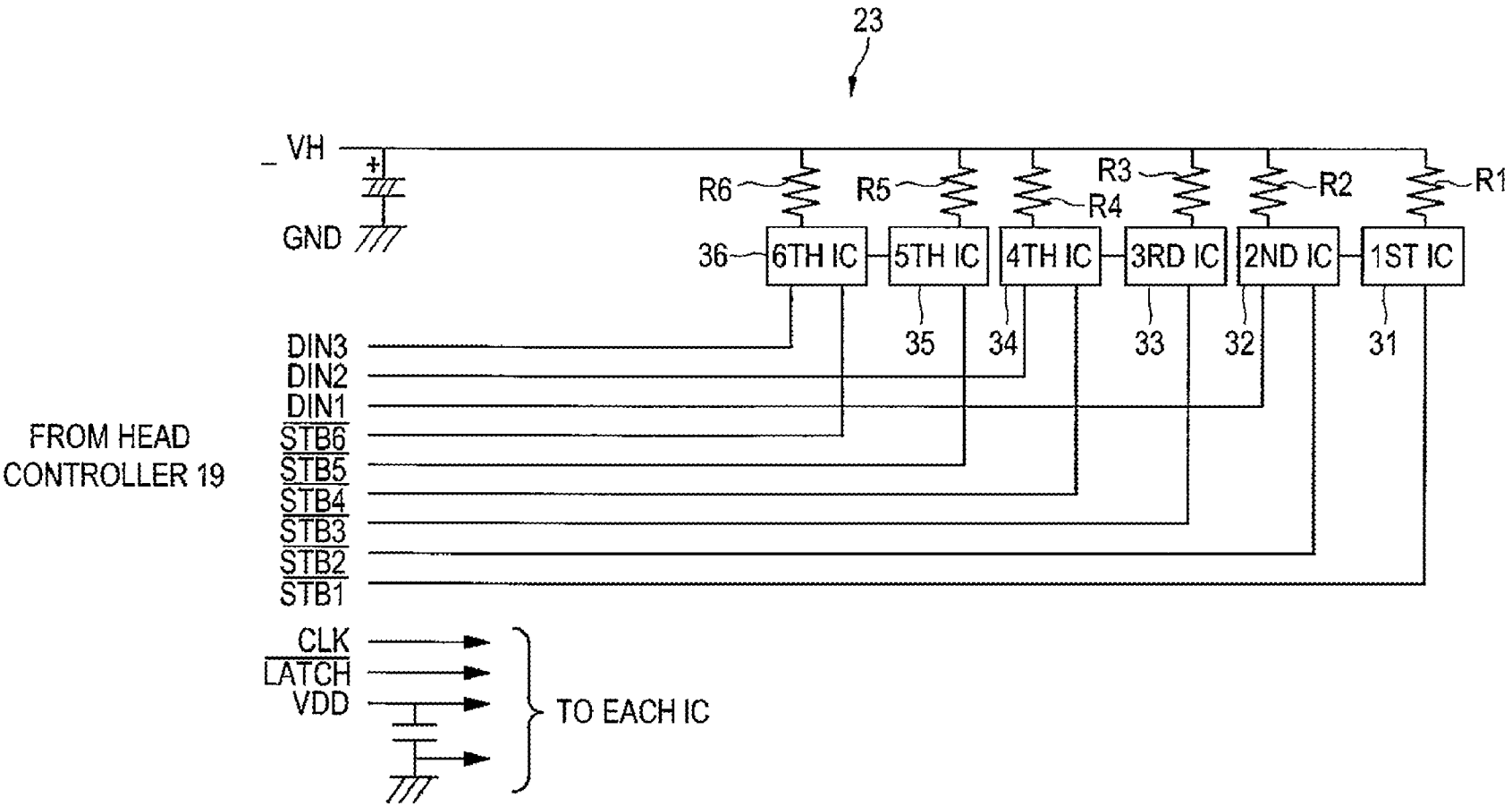
FIG. 3 is an illustrative embodiment of a circuit diagram of a thermal head and its peripheral parts of the thermal printing apparatus.

As shown in FIGS. 2 and 3, the thermal printing apparatus 1 may operate to conduct electric currents to heating elements R1-R6 arranged in a line within the thermal head 23 to transfer thermal energy to a thermal recording medium 26, to thereby effect printing. For such operation, the thermal recording medium 26 may be interposed and conveyed between the thermal head 23 and a platen roller 25. Although each of the heating elements R1-R6 has been shown as a single heating element for the sake of convenience in the embodiment illustrated in FIG. 3, it may include a plurality of heating elements. Each of the heating elements R1-R6, which may represent one or more heating elements, is assigned to one block.

In one embodiment, the thermal recording medium 26 may be a thermal paper having a color developing layer on its substrate, which may develop color when subject to heat. As shown in FIG. 3, the thermal head 23 may also include a first to sixth ICs 31-36. Each of the first to sixth ICs 31-36 may operate as a drive integrated circuit and may be connected to a respective heating element, R1-R6, which are arranged in a line within the thermal head 23, as explained above. The drive integrated circuit may include a shift register circuit for converting serial data into parallel data, a latch circuit for holding the converted parallel data, a gate circuit for controlling the latched data, and a transistor for applying a voltage (VH) to the thermal head 23. For example, the sixth IC 36 may operate to control a number of heating elements (i.e., 64 heating elements) represented by R6 among a total of 384 heating elements.

Print data may be controlled by serial signals DIN1-DIN3. In the embodiment illustrated in FIG. 3, one other drive integrated circuit may be cascaded to the adjacent drive integrated circuit to process the print data, wherein each pair of drive integrated circuits may be responsible for one macro block, which will be explained below. Upon receiving a serial signal, the drive integrated circuit may convert it into a parallel signal. Electric current conduction through the heating elements R1 to R6 may be controlled by strobe signals STB1-STB6, respectively.

Figure 4:
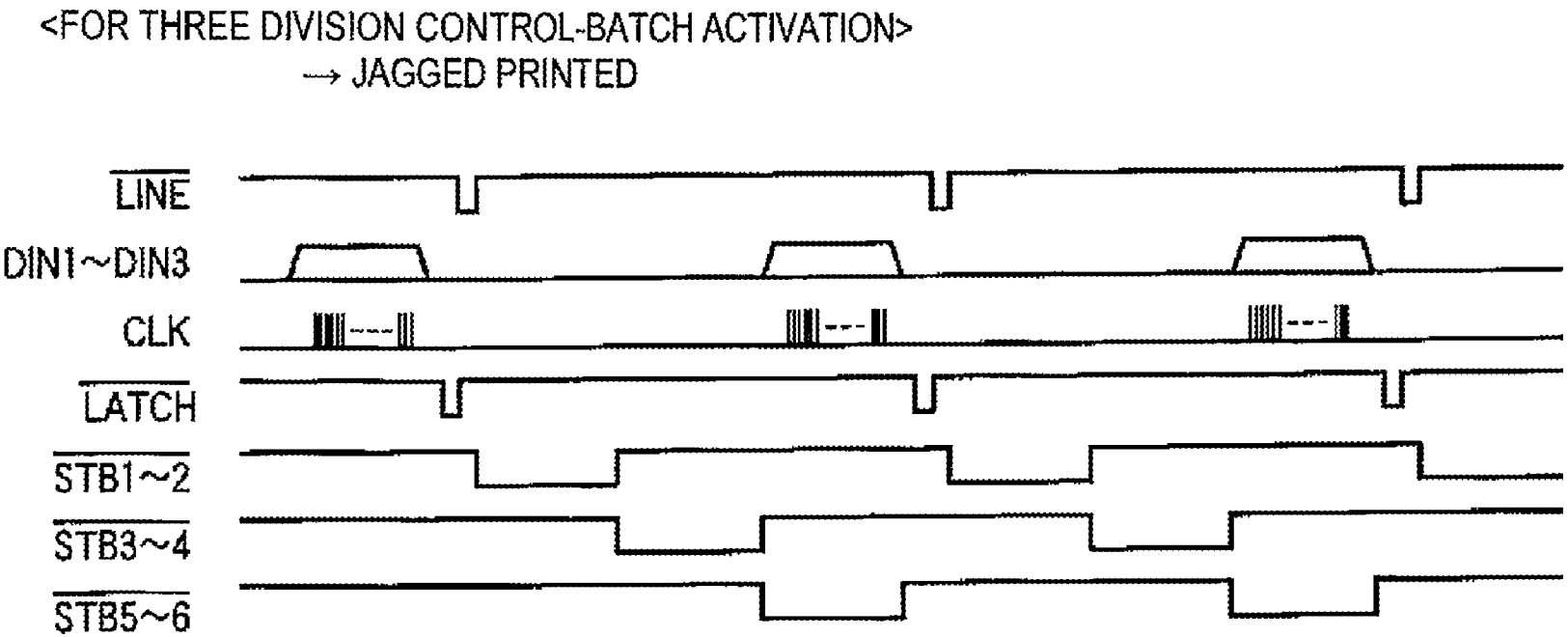
FIG. 4 is a timing diagram of an operation of the thermal head of the thermal printing apparatus in a batch manner of activation where the heating elements of the thermal head are divided into three macro blocks.

FIG. 4 shows a timing diagram of an operation of the thermal head of the thermal printing apparatus in a batch manner of activation where the heating elements R1-R6 of the thermal head are divided into three macro blocks. Such division of the heating elements may lend itself to sequential activation of the divided macro blocks during a print line time interval. In FIG. 4, the divided macro blocks are represented by three groups, STB1 and STB2, STB3 and STB4, and STB5 and STB6. If the thermal head 23 is controlled through electric current conduction once for each of the blocks per print line, the off-times to be assigned to the macro blocks may be prolonged compared to the case where the thermal head is controlled in the batch manner of activation, and a jagged appearance is manifested in the printed result as a result of the prolonged off-times, as shown in FIG. 5.

Figure 6:
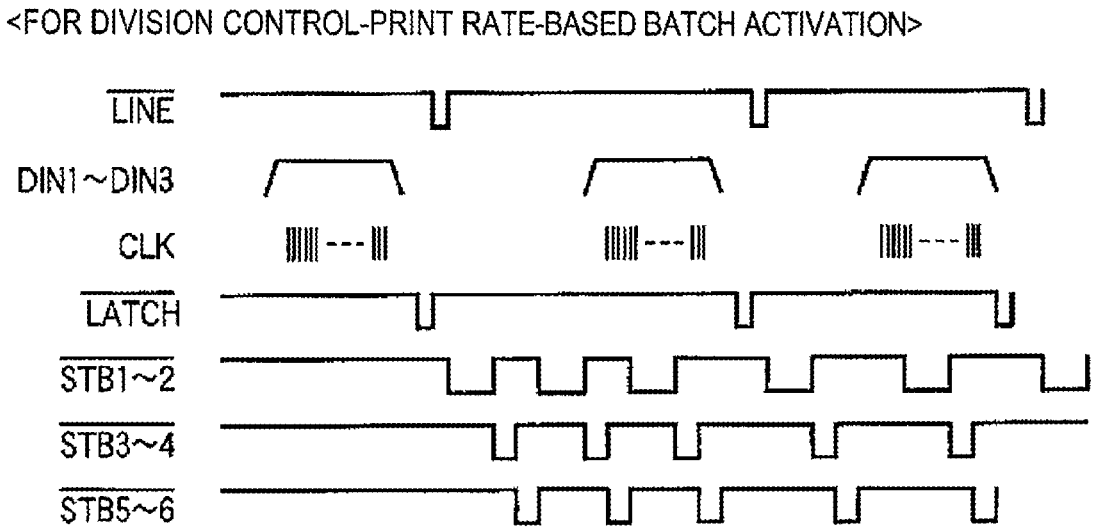
FIG. 6 is an illustrative embodiment of a timing diagram of an operation of the thermal head of the thermal printing apparatus based on a print rate and in a batch manner of activation where the heating elements of the thermal head are divided into three macro blocks and each of the three macro blocks is divided into three groups.
Figure 7:
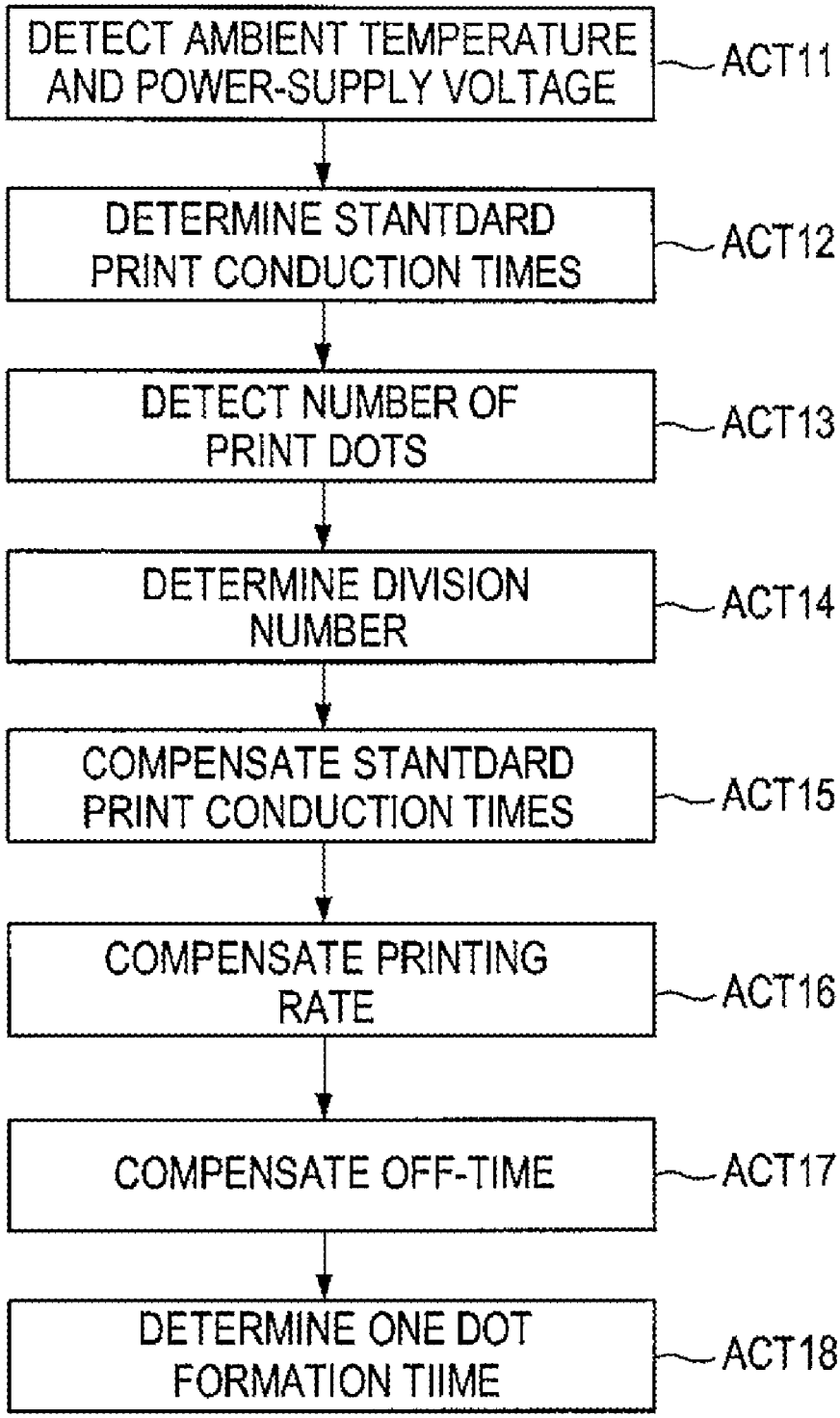
FIG. 7 is an illustrative embodiment of a flow diagram illustrating operations of the thermal printing apparatus where the thermal head is activated with the conduction times that have been processed by off-time based compensation.

In the meantime, as shown in the timing diagram of FIG. 6, electric current conduction is performed multiple times for the divided macro blocks and sequentially performed for the blocks within the macro block based on standard print conduction time assigned to that macro block during the print line time interval. According to this approach, a division number may be determined based on the total number of print dots consisting of one print line and power supply capacity, and the standard print conduction time for each of the macro blocks may be determined by detecting the number of print dots for the respective macro block. The conduction times may be compensated based on a temperature of the thermal head, an ambient temperature and a desired degree of fine adjustment of concentration. As will be described later, compensation of a print rate may be performed based on the print rate indicated by an image signal. The conduction time for each of the macro blocks may be increased by a constant fraction for every print dot increase in the respective macro block.

Figure 5:
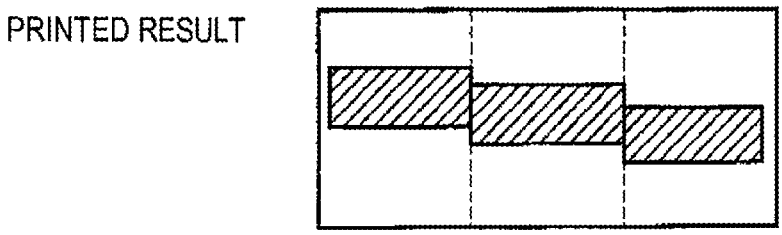
FIG. 5 is a printed result obtained by operating the thermal head as shown in FIG. 4 in a batch manner of activation.

While this approach is less likely to produce the jagged appearance in the printed result as shown in FIG. 5, it proved not to be effective in eliminating concentration unevenness to the degree of satisfaction, as will be described later.

Now, a detailed description of the off-time based compensation process of the standard print conduction time in accordance with an embodiment will be given with reference to FIG. 1, which shows an illustrative embodiment of a flow diagram illustrating operations of the thermal printing apparatus where the thermal head is activated with the conduction times that have been processed by off-time based compensation. Note that the compensation process as will be described below may be implemented by process programs stored in the ROM 13 and the RAM 14, which when executed by the CPU 12 will also control the head controller 19 in accordance with the compensation results.

As shown in FIG. 1, the CPU 12 may be connected to an outside air temperature detecting unit 41, a power-supply voltage detecting unit 42 and a head temperature detecting unit 43 via a bus line 24. The outside air temperature detecting unit 41 may be operable to detect the environment the thermal printing apparatus I is placed in. The power-supply voltage detecting unit 42 may be operable to detect a power-supply voltage to be applied to the thermal head 23. The head temperature detecting unit 43 may be operable to detect a temperature of the thermal head 23, which increases as an amount of the printing by the thermal head 23 increases. The CPU 12 may be configured to receive signals provided by the outside air temperature detecting unit 41, the power-supply voltage detecting unit 42 and the head temperature detecting unit 43. Those signals may include data indicating the environment the thermal printing apparatus 1 is placed in, a power-supply voltage to be applied to the thermal head 23 and a temperature of the thermal head 23. In one embodiment, a circuit for controlling the thermal head 23 or a conveyance activating time, which may be implemented by a Field Programmable Gate Array (FPGA), and an image memory, such as the RAM 14, may be connected to the CPU 12. In this case, the image memory may provide print data for use in operating the thermal head 23 via an interface.

Prior to staring the printing operation, the CPU 12, which is programmed with the process programs stored in the ROM 13 or the RAM 14, may issue a command to instruct the outside air temperature detecting unit 41 to detect an ambient temperature, and a command to instruct the power-supply voltage detecting unit 42 to detect a power-supply voltage to be applied to the thermal head 23 (act11). Thereafter, the CPU 12 may determine the standard print conduction times based on the two pieces of information as detected and by looking up a temperature table storing the characteristics of the thermal recording medium 26 to be used (act 12). In this case, the standard print conduction times as determined in this way may take different values depending on the characteristic of the thermal recording medium 26, a resistance value of the thermal head 23, pressure applied upon the thermal head 23 by the platen roller 25 or the like. As such, the CPU 12 may be programmed to read out and use experimentally predetermined numerical values from the RAM 14, etc.

Subsequently, the CPU 12 may detect the total number of print dots in one print line by referencing the image memory, such as the RAM 14 (act 13), and determine a division number based on the number of print dots whose simultaneous activation is allowed by the power-supply capacity (act 14). In one embodiment, the division number may be determined based at least in part on the power-supply capacity to be used. The criterion of determining the division number will be explained below.

- For printing of print dots less than 40% of a total 384 number of print dots (153 dots or lower): batch manner of activation
- For printing of print dots greater than or equal to 40% of a total 384 number of print dots and less than 60% of a total 384 number of print dots (154-230 dots): two division activation
- For printing of print dots greater than or equal to 60% of a total 384 number of print dots (231 dots or higher): three division activation Thereafter, the CPU 12 may further compensate the standard print conduction times, as determined at act 12, based on a temperature of the thermal head 23 detected at the head temperature detecting unit 43 and an amount of fine adjustment of concentration, by which the conduction times will be increased or decreased (act 15). In one embodiment, the head temperature detecting unit 43 may include a thermistor mounted on the thermal head 23. In one embodiment, the amount of fine adjustment of concentration may be provided by a concentration fine adjustment compensating unit 44. In another embodiment, the user may input a numerical value by using the input device 21, such as a keyboard or a control panel, to set the amount of fine adjustment of concentration. The inputted numerical value indicating the amount of fine adjustment of concentration may be stored in a memory area of the RAM 14.

Then, at act 16, the number of print dots for each of the macro blocks as determined by the division number and a compensation time may be determined and the determined compensation time may be added to the standard print conduction time. Specifically, the CPU 12 may invoke a block print number detecting unit 45 to detect the number of print dots for each of the macro blocks based on an image signal provided as print data. The CPU 12 may store the number of print dots in the memory area of the RAM 14 for the purpose of reading out the same later. The CPU 12 may determine the compensation time based on the number of print dots for each of the macro blocks detected at the block print number detecting unit 45. The CPU 12 may then add the compensation time to the standard print conduction time. The compensation time may be predetermined experimentally based on the characteristics of the thermal head 23 to be used or the power-supply capacity. Experimentally determining the compensation time may involve measuring a voltage drop caused by a change in print rate and determining a print conduction time, which can ensure that uniform concentration is maintained even with a change in print rate.

Thereafter, the CPU 12 may perform off-time based print conduction time compensation. Note that the off-time for a particular macro block, which is equal to the time period with the print conduction time determined above for the respective macro block being excluded, corresponds to a sum of the print conduction times for other macro blocks. Thus, when a print rate of the particular macro block is small and those of other macro blocks are larger, the off-times for other macro blocks may become longer out of proportion than the print conduction time for the particular macro block. As a result, the macro blocks may have deviations in terms of print conduction time. Thus, to alleviate the deviation problem in print conduction time, the CPU 12 may compensate the print conduction time for the particular macro block based on the off-time for the particular macro block (i.e., a sum of the print conduction times for other macro blocks) (act 17).

Finally, the CPU 12 may calculate a total sum of the print conduction times for the macro blocks based on the compensated print conduction times, and may further determine, as one dot formation time, an amount of time obtained by multiplying the total sum by an iteration number in one print line (act 18), The CPU 12 may allow the thermal head 23 to form an image on the thermal recording medium 26, based on the determined amount of time, under the control of the head controller 19.

As used in this application, entities for executing the actions can refer to a computer-related entity, either hardware, a combination of hardware and software, software, or software in execution. For example, an entity for executing an action can be, but is not limited to being, a process running on a processor, a processor, an object, an executable, a thread of execution, a program, and a computer. By way of illustration, both an application running on an apparatus and the apparatus can be an entity. One or more entities can reside within a process and/or thread of execution and an entity can be localized on one apparatus and/or distributed between two or more apparatuses.

The program for realizing the functions can be recorded in the apparatus, can be downloaded through a network to the apparatus and can be installed in the apparatus from a computer readable storage medium storing the program therein. A form of the computer readable storage medium can be any form as long as the computer readable storage medium can store programs and is readable by the apparatus such as a disk type ROM and a solid-state computer storage media. The functions obtained by installation or download in advance in this way can be realized in cooperation with an OS(Operating System) or the like in the apparatus.

Figure 8:
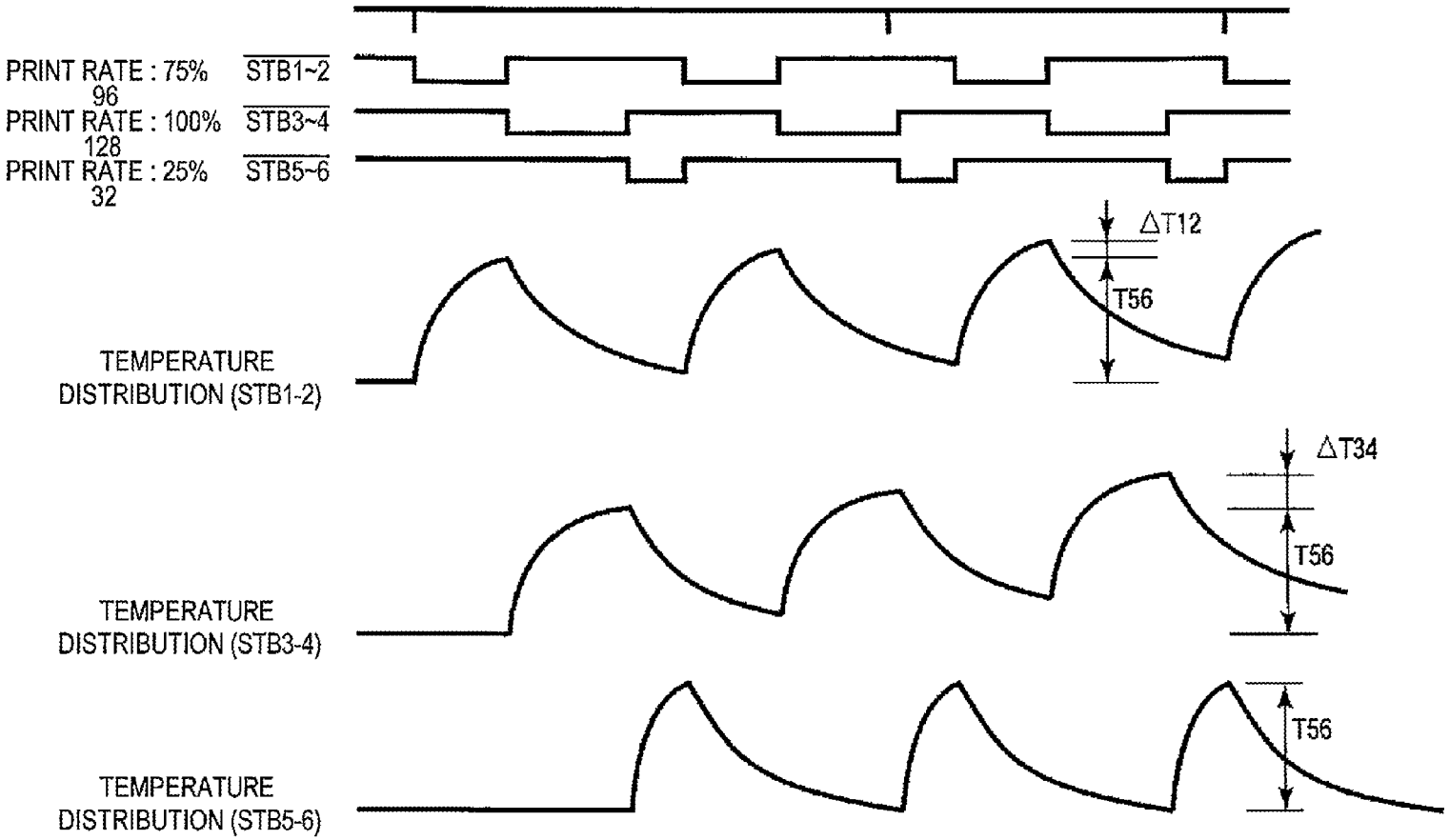
FIG. 8 is an illustrative embodiment of a diagram showing a relationship between a print rate and a temperature distribution in the thermal head.
Figure 9:
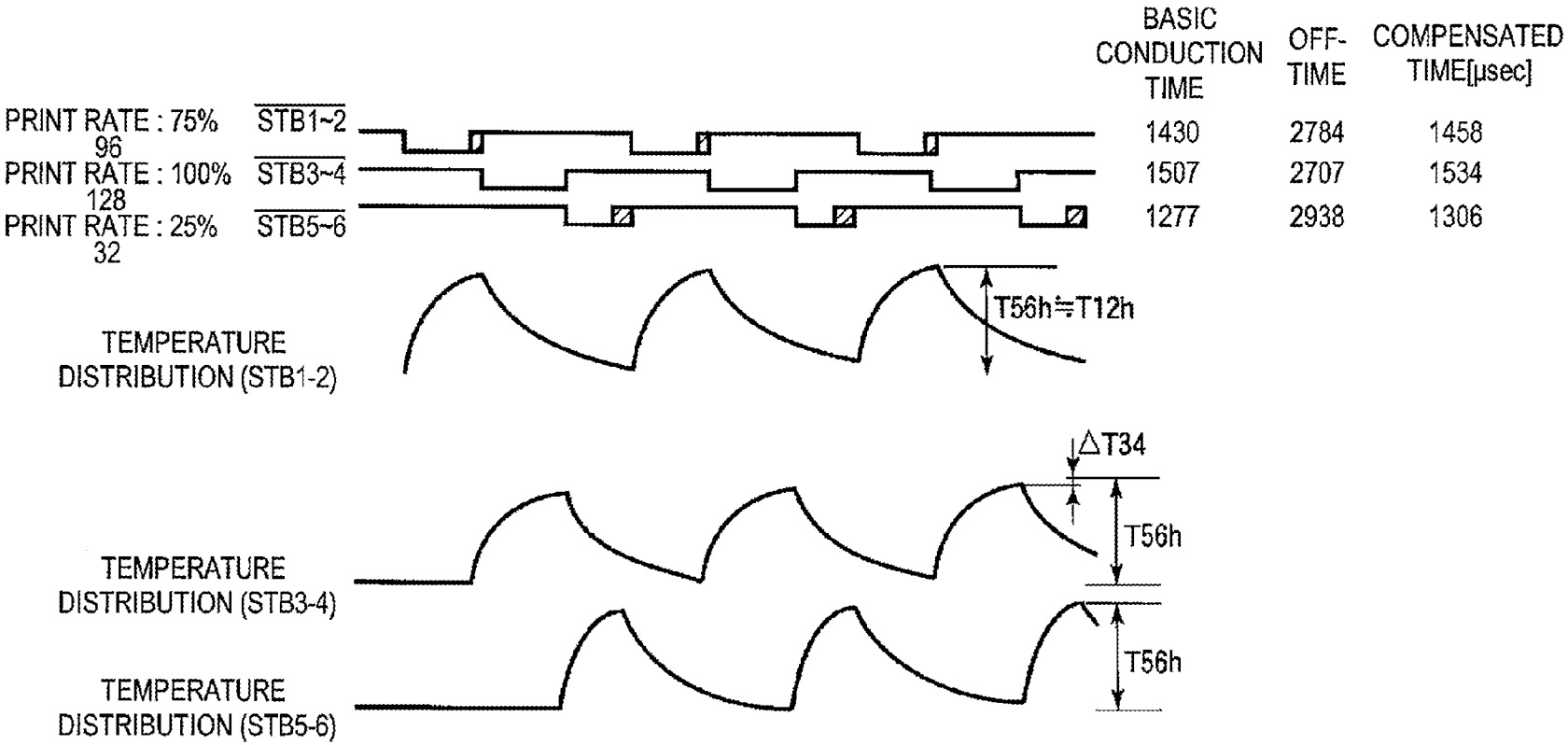
FIG. 9 is an illustrative embodiment of a diagram explaining conduction time compensation based on a relationship between the print rate and the temperature distribution and on the off-time.

Hereinafter, an explanation of a specific embodiment of the off-time based compensation process of a standard print conduction time, which is performed at act 17, will be given with reference to FIGS. 8 and 9. Specifically, FIG. 8 is an illustrative embodiment of a diagram showing the relationship between a print rate and a temperature distribution in the thermal head. FIG. 9 is an illustrative embodiment of a diagram explaining conduction time compensation based on the relationship between the print rate and the temperature distribution and on the off-time.

In the embodiment illustrated in FIG. 8, it is assumed that a print rate assigned to the macro block STB 1-2 is 75% (48 dots), a print rate assigned to the macro block STB 3-4 is 100% (64 dots), and a print rate assigned to the macro block STB 5-6 is 25% (16 dots).

Since the standard print conduction time is divided into three time intervals, the standard print conduction time is set to 1200 μsec (at an ambient temperature of 20° C. and a head temperature of 20° C.). Further if the standard print conduction time is compensated based on the number of print dots, the standard print conduction times may be obtained as follows:

STB 1-2: 1200*(1+48*0.002)=1315 μsec

STB 3-4: 1200*(1+64*0.002)=1354 μsec

STB 5-6: 1200*(1+16*0.002)=1238 μsec

FIG. 8 shows a conceptual diagram of the head temperature distribution during the compensation process. Each pixel may be formed by three activation times for one dot. The STBs may have different conduction times due to differences in print rate with the result that the head temperatures of the STBs may be slightly different.

Referring to FIG. 8, the temperatures for the STBs 1-2 and 3-4 are compared to the temperature T56 for the STB 5-6. The temperature T34 for the STB 3-4 is higher than the temperature T56 by a temperature deviation ΔT34, and the temperature T12 for the STB 1-2 is higher than the temperature T56 for the STB 5-6 by a temperature deviation ΔT12. These temperature differences may cause print concentration differences, which in turn lead to concentration unevenness. As a result, the print quality may deteriorate.

This may be accounted for by the fact that the off time of each macro block varies depending on the print rates of the macro blocks other than the respective macro block. The varying off times for the macro blocks may result in different start temperatures of the thermal head as measured prior to the conduction thereof, thereby leading to different peak temperatures. Compensating the temperature difference in each macro block may require compensating the standard print conduction time based on the off-times of the macro blocks other than the respective macro block. This may allow the temperatures to be uniform in the interval, during which each macro block is conducted.

A description of an illustrative embodiment of a value obtained by the off-time based compensation of a standard print conduction time will be given with reference to FIG. 9.

In the embodiment illustrated in FIG. 9, 0.2% increase for one dot is assumed when a standard print conduction time is 1200 μsec. Then, the standard print conduction times of the macro blocks may be defined as follows:

1st macro block (96 dots print): 1430 μsec

2nd macro block (128 dots print): 1507 μsec

3rd macro block (32 dots print): 1277 μsec

Thus, the off-time between the pulses in each block may be derived as follows:

1st block (96 dots print): 2784 μsec

2nd block (128 dots print): 2707 μsec

3rd block (32 dots print): 2938 μsec

In accordance with an illustrative embodiment, with the compensation of the standard print conduction time based on the off-times in the macro blocks, it is possible to optimize print concentration in each block, to thereby prevent concentration unevenness.

Specifically, as shown in FIG. 9, for the three division activation, the total print dot number is 256 dots (about 67% of the print rate) and the off-times of other macro blocks are different from each other. For other macro blocks, the actual off-times may vary slightly according to a control signal asserted for every print line. Differences in off-time between the macro blocks may cause different cooling times of the thermal head, which result in a temperature difference in the thermal head. Also, the temperature difference in the thermal head may cause unevenness in print concentration.

For example, the CPU 12 may add 1% of the off-time for each block to the standard print conduction time of the respective macro block by performing the functions of the programs stored in the ROM 13 and the RAM 14. While the percentage of the off time to be added to the standard print conduction time may be set to 1%, it may not be limited thereto. For example, the percentage may depend on the type of thermal head or head pressure of the thermal printer. As such, an optimal percentage value may be experimentally determined by means of actual measurements. The standard print conduction times of the macro blocks with 1% of the respective off-times for those macro blocks added thereto are as follows:

1st macro block: 1458 μsec (standard print conduction time)

2nd macro block: 1534 μsec (standard print conduction time)

3rd macro block: 1306 μsec (standard print conduction time)

For example, if the macro block tends to make the temperature of the thermal head lowered due to a long off-time, an additional amount of time proportional to the long off-time is allocated to the respective macro block. Such allocation may allow the standard print conduction time to be increased by the additional amount of time, elevating the temperature of the thermal head. Conversely, when the macro block tends to make the temperature of the thermal head rise due to a relatively short off-time, an additional amount of time proportional to the relatively short off-time is allocated to the respective macro block. Such allocation may allow the standard print conduction time to be decreased by the additional amount of time, making the temperature of the thermal head relatively low.

As such, it will be readily appreciated that although differences in print rate between the macro blocks may cause differences in off-time, the off-time based compensation of the standard print conduction time may allow the temperature differences between the STBs to be alleviated. For example, from FIG. 9, it will be appreciated that there is little difference between the temperatures T12, T34 and T56 of the STBs 1-2, 3-4 and 5-6.

Therefore, in accordance with the illustrated embodiment above, an amount of time determined based on the off-time may be added to the standard print conduction time. This may compensate variations in off-time, which may be caused by the differences in standard print conduction time between the macro blocks, which in turn is caused by different print rates. Thus, in the illustrated embodiment, it is made possible to obtain a high-quality printed result with only slight print unevenness by overcoming a problem associated with a temperature difference of the thermal head between the macro blocks.

It will be readily appreciated that compensation of the print conduction times for a particular macro block based on the print rates or the print conduction times for other macro blocks may be differently implemented depending on the type of thermal recording medium or thermal head, etc. to be used in conjunction with the illustrated embodiment.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printing apparatus comprising:

a thermal head having a plurality of heating elements arranged in a line therein; and a control unit configured to determine conduction times of the heating elements based on print rates respectively assigned to the plurality of heating elements, compensate each of the determined conduction times based on the conduction times of the heating elements other than the respective heating element to determine a plurality of compensated conduction times, and control each of the plurality of heating elements based on the respective one of the plurality of compensated conduction times to enable the thermal head to perform printing on a recording medium.

2. The apparatus of claim 1, wherein the control unit is configured to determine an off-time of each of the heating elements during which the respective heating element is turned off based on the conduction times of the heating elements other than the respective heating element and determine the compensated conduction times based on the respectively determined off-times.

3. The apparatus of claim 2, wherein the control unit is further configured to add an amount of time obtained by multiplying the off-time of each of the plurality of heating elements by a predetermined value to the conduction time of the respective heating element, to thereby determine the compensated conduction time of the respective heating element.

4. The apparatus of claim 1, further comprising an outside air temperature detecting unit coupled to the control unit to detect an outside air temperature the printing apparatus is placed in to provide the temperature data and wherein the control unit is further configured to receive the temperature data for use in determining the conduction times of the heating elements.

5. The apparatus of claim 1, further comprising a power-supply voltage detecting unit coupled to the control unit to detect a power-supply voltage to be applied to the thermal head to provide power-supply voltage data and wherein the control unit is further configured to receive the power-supply voltage data for use in determining the conduction times of the heating elements.

6. The apparatus of claim 1, further comprising a thermal head temperature detecting unit coupled to the control unit to detect a temperature of the thermal head to provide head temperature data wherein the control unit is further configured to receive the head temperature data for use in determining the conduction times of the heating elements.

7. The apparatus of claim 1, further comprising a concentration fine adjustment compensating unit coupled to the control unit to set an amount of fine adjustment of concentration and wherein the control unit is further configured to receive data related to the amount of fine adjustment of concentration from the concentration fine adjustment compensating unit for use in compensating each of the determined conduction times.

8. The apparatus of claim 7, wherein the concentration fine adjustment compensating unit is configured to receive a numerical value indicative of the amount of fine adjustment of concentration from a user.

9. A method of controlling a printing apparatus having a plurality of heating elements arranged in a line therein, the method comprising:

determining conduction times of the heating elements based on print rates respectively assigned to the plurality of heating elements;

compensating each of the determined conduction times based on the conduction times of the heating elements other than the respective heating element to determine a plurality of compensated conduction times; and controlling each of the plurality of heating elements based on the respective one of the plurality of compensated conduction times to enable the thermal head to perform printing on a recording medium.

10. The method of claim 9, wherein the controlling comprises determining an off-time of each heating element during which the respective heating element is turned off based on the conduction times of the heating elements other than the respective heating element and determining the compensated conduction times based on the respectively determined off-times.

11. The method of claim 10, wherein the controlling further comprises adding an amount of time obtained by multiplying the off-time of each of the plurality of heating elements by a predetermined value to the conduction time of the respective heating element, to thereby determine the compensated conduction time of the respective heating element.

12. The method of claim 9, wherein the determining comprises detecting an outside air temperature the printing apparatus is placed in to provide temperature data and using the temperature data in determining the conduction times of the heating elements.

13. The method of claim 9, wherein the determining further comprises detecting a power-supply voltage to be applied to the thermal head to provide power-supply voltage data and using the power-supply voltage data in determining the conduction times of the heating elements.

14. The method of claim 9, wherein the determining further comprises detecting a temperature of the thermal head to provide head temperature data and using the head temperature data in determining the conduction times of the heating elements.

15. The method of claim 9, wherein the compensating comprises setting an amount of fine adjustment of concentration and using the amount of fine adjustment of concentration in compensating each of the determined conduction times.

16. The method of claim 15, wherein the setting comprises receiving a numerical value indicative of the amount of fine adjustment of concentration from a user.

17. A printing apparatus comprising:

a printing head having a plurality of heating elements, each of the plurality of heating elements being associated with a print rate; and a control unit configured to determine a conduction time of each of the heating elements based on the respective print rate associated therewith and compensate each of the conduction times based on the remaining conduction times other than the respective conduction time.

18. The apparatus of claim 17, wherein the control unit is further configured to determine an off-time of each of the heating elements during which the respective heating element is turned off based on the remaining conduction times and determine compensated conduction times of the heating elements based on the respectively determined off-times.

19. The apparatus of claim 17, further comprising an outside air temperature detecting unit coupled to the control unit to detect an environment the printing apparatus is placed in to provide environment data and wherein the control unit is further configured to receive the environment data for use in determining the conduction times of the heating elements.

20. The apparatus of claim 17, further comprising a power-supply voltage detecting unit coupled to the control unit to detect a power-supply voltage to be applied to the printing head to provide power-supply voltage data and wherein the control unit is further configured to receive the power-supply voltage data for use in determining the conduction times of the heating elements.

* * * * *